United States Patent [19]

Moomaw

[11] Patent Number: 4,768,989

[45] Date of Patent: Sep. 6, 1988

[54] TOY TEAKETTLE WITH HANDLE MECHANISM

[75] Inventor: David E. Moomaw, East Aurora, N.Y.

[73] Assignee: The Quaker Oats Company, Chicago, Ill.

[21] Appl. No.: 920,694

[22] Filed: Oct. 17, 1986

[51] Int. Cl.[4] ..... A63H 33/30; A63H 3/31

[52] U.S. Cl. ..... 446/193; 446/404; 446/481; 272/8 R

[58] Field of Search ..... 446/481, 483, 404, 144, 446/178, 24, 188, 193, 197, 475, 486, 480; 272/8 R, 8 N, 1 R; 222/471, 472, 473

[56] References Cited

U.S. PATENT DOCUMENTS

| | | | |
|---|---|---|---|
| 513,450 | 1/1894 | Armstrong | 272/8 R |
| 1,488,626 | 4/1924 | Steiner et al. | 446/193 |
| 1,506,567 | 8/1924 | Cohn | 446/193 |
| 2,116,183 | 5/1938 | Beach et al. | 446/193 |
| 2,504,541 | 4/1950 | Lawson, Jr. | 446/188 |
| 3,078,607 | 2/1963 | Butler et al. | 446/481 X |
| 3,205,610 | 9/1965 | Palumbo et al. | 446/481 X |
| 3,774,338 | 11/1973 | Waak | 446/481 X |
| 3,827,824 | 8/1974 | Waak | 446/481 X |
| 3,831,314 | 8/1974 | Bass et al. | 446/481 X |
| 3,846,933 | 11/1974 | Hill et al. | 446/481 X |
| 4,332,101 | 1/1982 | Tomita | 446/481 X |

FOREIGN PATENT DOCUMENTS

| | | | |
|---|---|---|---|
| 537705 | 5/1955 | Belgium | 222/472 |
| 763255 | 12/1956 | United Kingdom | 222/472 |

*Primary Examiner*—Richard T. Stouffer
*Assistant Examiner*—D. Neal Muir
*Attorney, Agent, or Firm*—Cumpston & Shaw

[57] ABSTRACT

A toy tea kettle or the like has a spout and whistling means to simulate the sound made by steam escaping from a boiling kettle. The spout has a lid, and the kettle has a toothed rack coupled to the lid for oscillating the lid to simulate the action of an actual kettle lid in response to steam escaping from the spout. The kettle further has a reciprocally movable plunger coupled to the toothed rack for moving the lid to a fully opened position upon depression of the plunger to prepare the kettle for pouring.

15 Claims, 2 Drawing Sheets

TOY TEAKETTLE WITH HANDLE MECHANISM

BACKGROUND OF THE INVENTION

1. Field of the Invention

This invention relates generally to toys, and more particularly to a toy tea kettle or the like.

2. Description of the prior art

Children love to imitate adults, and it is not uncommon to observe them in the act of "playing house". One aspect of "playing house" which they love involves entertaining guests by serving beverages to them, such as hot coffee or tea, in toy tea kettles or the like. These tea kettles simulate actual tea kettles except that they are smaller and the only moving parts are possibly a removable cover and a pivotally movable handle. Although the known toy tea kettle or the like serves a useful function, it fails to realistically simulate an actual tea kettle in which the liquid therein is boiling and the steam escaping from the kettle emits a whistling sound and causes the spout lid to oscillate. Also, no toy tea kettle is known wherein by pressing a button or plunger the spout lid can be held in a fully opened position to enable the child to pour make-believe tea or the like into miniature teacups.

SUMMARY OF THE INVENTION

An object of the present invention is to provide a toy tea kettle comprising:

- a body having a spout;
- a handle supported by the body for movement between a normal lowered position and a raised position;
- a bellows movable between a normal deflated condition and an inflated condition, and having one portion thereof coupled to the handle and
- a whistling means coupled to the bellows such that movement of the handle to its raised position inflates the bellows by drawing air therein through the whistling means, and movement of the handle to its lowered position deflates the bellows expelling air through the whistling means to produce a whistling sound simulating steam escaping through the spout.

Another object of the invention is to provide a toy tea kettle or the like comprising:

- a body having a spout;
- a lid on the spout movable between a normal closed position and a partially opened position;
- a handle supported by the body for movement between a normal lowered position and a raised position; and
- means on the handle coupled to the lid for oscillating the lid between its closed and partially opened positions upon movement of the handle from its raised position to its lowered position, thereby simulating an oscillating lid caused by steam escaping from the spout.

Still another object of the present invention is to provide a toy tea kettle or the like comprising:

- a body having a spout;
- a lid on the spout movable between a normally closed position and an open position;
- a handle supported by the body;
- a reciprocally movable plunger mounted on the handle for movement between a normal up position and a down position;

- a tooth slidably mounted on the handle; and
- means coupling the plunger to the tooth such that the tooth engages and moves the lid to its open position upon movement of the plunger to its down position.

A primary advantage of the present invention is to provide a toy tea kettle or the like that more realistically simulates an actual tea kettle used by adults. For example, the toy tea kettle makes a whistling noise simulating the sound made by steam escaping from the tea kettle, has an oscillating lid to simulate the action of a lid under the influence of steam escaping from the spout, and a depressible plunger for moving the spout lid to a fully open position to enable the child to pour make-believe tea or the like into miniature cups.

BRIEF DESCRIPTION OF THE DRAWINGS

In the detailed description of the invention presented below, reference is made to the accompanying drawings, in which.

DETAILED DESCRIPTION OF THE INVENTION

Figure 1:
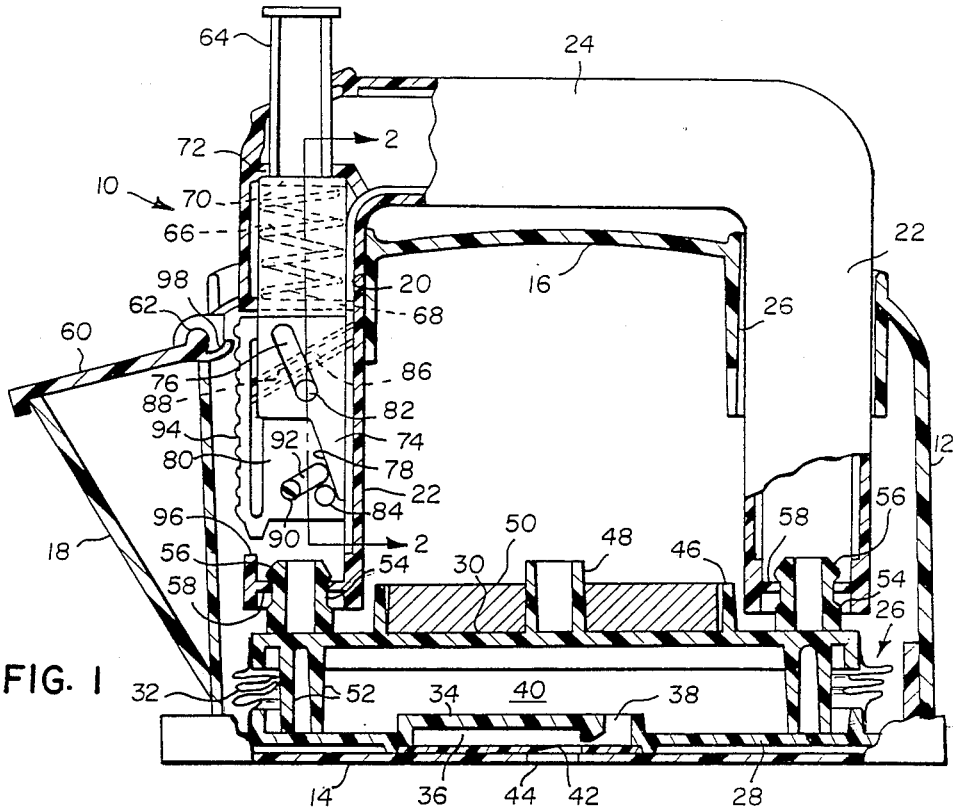
FIG. 1 is a side elevation view, partially in section, of a preferred embodiment of the toy tea kettle or the like of this invention with the handle thereof in its normal lowered position and the plunger thereof in its normal up position.

Referring now to FIG. 1 of the drawings, a preferred embodiment of the toy tea kettle 10 of this invention is shown in its normal position, in which all of the parts thereof are at rest. The kettle 10 generally comprises a hollow body 12 having a circular bottom 14, a cover 16 and a simulated spout 18. The cover 16 has a pair of spaced apart sleeved openings 20 for slidably supporting legs 22 of a U shaped, preferably tubular handle 24. The handle 26 is manually slidably movable from its lowermost position shown in FIG. 1 to its uppermost position shown in FIG. 2.

The mechanism for simulating a whistling sound comprises a bellows 26 having a circular plate-like base member 28, a circular plate-like top member 30, and a pleated expansible cylindrical member 32 joining the base and the top members together. The bellows base member 28 is secured by an suitable means to kettle bottom 12, and a circular raised wall 34 in base member 28 defines a chamber 36 having an opening 38 communicating with the interior cavity 40 of bellows 26. A whistle reed 42 is interposed between the raised wall 34 and kettle bottom 14 with the reed overlying an opening 44 in kettle bottom 14. The top member 30 of bellows 26 has upstanding rings 46, 48 defining an annular cavity for receiving a doughnut-shaped weight 50. The weight forces top member 30 of bellows 26 downwardly compressing or deflating the bellows until a pair of rings 52 depending from the top member engage the base of member 28. The top member 30 of bellows 26 is connected to handle 24 by a pair of upstanding spindles 54 secured to top member 30 and having upper rims 56 that are forced through openings in flexible diaphragms 58 at the lower end of the handle legs 22.

Figure 2:
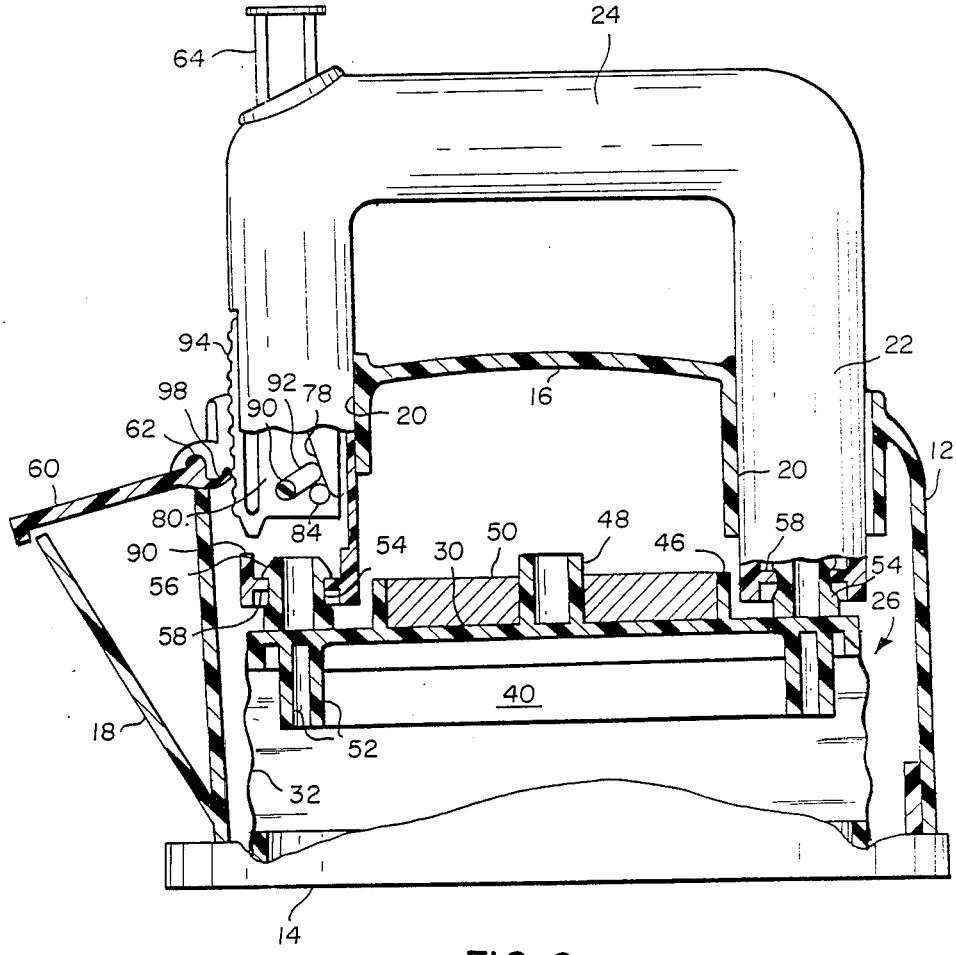
FIG. 2 is a side elevation view similar to FIG. 1 showing the handle in its raised position.

Accordingly, when handle 24 is raised from its lowermost position shown in FIG. 1 to its raised position shown in FIG. 2, bellows 26 is inflated with air drawn through openings 38, 44. When handle 24 is released, weight 50 moves bellows 26, top member 30 and handle 24 downwardly, deflating the bellows and forcing air through openings 38, 44 causing whistle reed 42 to vibrate and emit and sound simulating the whistle sound made by a tea kettle in which the liquid therein is boiling.

Figure 3:
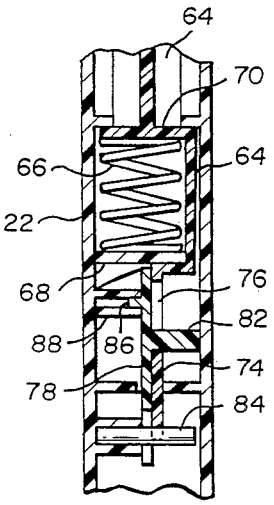
FIG. 3 is a segmental section view taken substantially along line 2—2 of FIG. 1.

The mechanism for oscillating a lid 60, which is pivotally mounted on spout 18 about a pivot 62, to simulate the action of the spout lid when steam is escaping therethrough will now be described. A plunger 64 is slidably mounted within hollow leg 22 adjacent spout 18. The plunger is normally maintained in its up position by a spring 66 within the hollow leg having one end bearing against a laterally extending shelf 68 on the leg and its opposite end bearing against a laterally extending plunger shelf 70 on the plunger, as best seen in FIG. 3. The spring forces plunger shelf 70 into engagement with an annular shoulder 72 on the leg for holding the plunger in its normal up position. The opposite end of plunger 64 comprises a flat plate-like cam member 74 comprising an inclined slot 76 and an inclined surface 78. A flat follower plate 80 is slidably coupled to cam member 74 by a pair of pins 82, 84 laterally extending from plate 80, one pin 82 extending into inclined slot 76 and the other pin 84 positioned adjacent inclined surface 78. The lateral and downward movement of follower plate 80 is guided by a lug 86 on the rear surface of follower plate 80 slidable within an inclined groove 88 in the leg 22, and also by a pin 90 on the leg extending through an inclined slot 92 in follower plate 80. The follower plate further has a toothed rack 94 on one side thereof, extending through a slot 96 in the leg. Accordingly, as plunger 64 is depressed, cam slot 76 and inclined surface 78 move the cam follower pins 82, 84 and follower plate 80 laterally and slightly downwardly by virtue of the guiding action of lug 86 in groove 88 and pin 90 in slot 92. In the normal up position of plunger 64, as seen in FIG. 1, follower plate pin 82 is engaged by an end of inclined cam slot 76 for holding follower plate 80 in a captive position with the toothed rack 94 in slight engagement with a flexible finger 98 extending from lid 60. Accordingly, when handle 24 is manually raised to its raised position, as seen in FIG. 2, follower plate 80 is lifted with plunger 64 and leg 22 without affecting lid 60 which is intermittently urged into tighter engagement with spout 18 by the finger 98 and toothed rack 94 interconnection as the rack is raised. When handle 24 is released, weight 50 causes bellows 26 to deflate and the handle to be lowered. During this action, the teeth on toothed rack 94 intermittently engage finger 98 on lid 60 and intermittently pivot the lid as the finger rides on the teeth, causing the lid to oscillate, that is, partially open and close as the lid passes each tooth. The oscillating lid 60 simulates the oscillating lid of an actual kettle caused by steam escaping through the spout.

Figure 4:
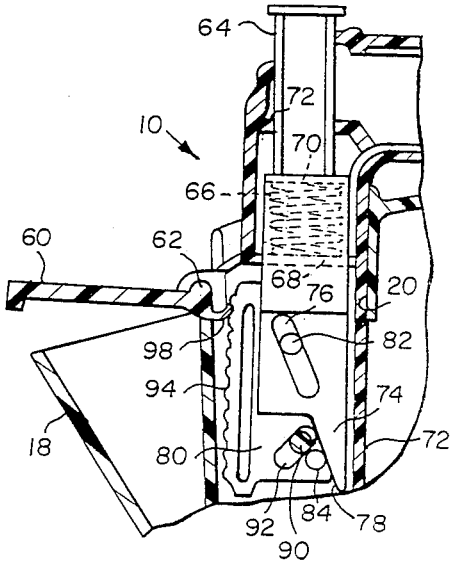
FIG. 4 is a segmental section view showing the plunger in its down position for holding the lid in its fully opened position in preparation for pouring.

With reference to FIG. 4, plunger 64 is manually depressed into its down position to move and hold lid 60 in its fully opened position to pour make-believe tea or the like into suitable cups. Depression of plunger 64 causes cam member 74 to cam pins 82, 84 on the follower plate 80 and toothed rack 94 laterally, via inclined slot 76 and inclined surface 78, and downwardly, via lug 86 in inclined groove 88 and pin 90 in inclined slot 92, causing a tooth on rack 94 to engage finger 98 and pivot lid 60 into its fully opened position. the lid remains in this position as long as the plunger 64 is depressed. If desired, the angles of the cam surface 78 and guide slot 92 could be selected to impart a slight pivotal movement to follower plate 80 as it is moved slightly laterally and downwardly.

While a preferred embodiment of the invention has been shown and described with particularlity, it will be appreciated that various changes and modifications may suggest themselves to one having ordinary skill in the art on being apprised of the present invention. It is intended to encompass all such changes and modifications as fall within the scope and spirit of the appended claims.

What is claimed is:

1. A toy tea kettle comprising:

a hollow body having a spout;

a cover having a pair of spaced-apart openings;

a U-shaped handle having a center handle portion and parallel legs slidably movable in the openings for movement between a normal lowered position and a raised position;

a bellows movable between a normal deflated condition and an inflated condition, and having a flat rigid top member having a pair of spaced-apart spindles coupled to ends of the legs, and a pleated expansible cylindrical member having one end secured to the top member and the opposite end secured to the body; and a whistling means coupled to the bellows such that movement of the handle to its raised position inflates the bellows by drawing air therein, and movement of the handle to its lowered position deflates the bellows expelling air through the whistling means to produce a whistling sound simulating steam escaping through the spout.

2. A toy tea kettle according to claim 1, and further comprising a lid on the spout that is movable between a normal closed position and a partially opened position, and a means on the handle coupled to the lid for oscillating the lid between its closed and partially opened positions upon movement of the handle from its raised position to its loweed position, thereby simulating an actual oscillating lid caused by steam escaping through the spout.

3. A toy tea kettle according to claim 2 wherein the means for oscillating the lid comprises a toothed rack, and wherein the lid is pivotally mounted on the spout and has an oppositely extending finger intermittently engaging the toothed rack.

4. A toy tea kettle according to claim 3 wherein the toothed rack is slidably mounted on the handle, cam follower means are mounted on the rack, a reciprocally movable plunger is mounted on the handle for movement between a normal up position and a down position, cam means are mounted on the plunger for actuating the cam follower means upon movement of the plunger to its downward position, and guide means are provided between the rack and the handle for guiding the rack in a laterally downward direction for moving and holding the lid in a fully opened position upon movement of the plunger to its down position.

5. A toy tea kettle according to claim 4 whrein the handle has a hollow depending leg having a slot within which the rack is slidably mounted, the plunger is reciprocally movable within the hollow leg, the cam follower means comprises a laterally extending pin on the rack, the cam means comprises an inclined surface on the plunger in engagement with the pin, and the guide means comprises a lug on the rack sliding in a groove in the leg.

6. A toy tea kettle according to claim 5 wherein a spring is interposed between the handle and the plunger for biasing the plunger into its normal up position.

7. A toy tea kettle comprising:

a body having a spout;

a lid on the spout movable between a normal closed position and a partially opened position;

a handle supported by the body for movement relative to said body between a normal lowered position and a raised position; and means on the handle coupled to the lid for oscillating the lid, said oscillating means generating intermittent upward forces on the lid to move the lid from its closed position to its partially opened position and back to its closed position several times during a single unidirectional motion of said handle from its raised position to its lowered position, said oscillating means being directly acted upon by said handle to immediately cease its generation of intermittent upward forces on said lid as soon as said handle ceases said movement relative to said body, thereby simulating actual oscillation of the lid caused by steam escaping through the spout.

8. A toy tea kettle according to claim 7 wherein the means for oscillating the lid comprises a toothed rack and wherein the lid is pivotally mounted on the spout and has an oppositely extending finger intermittently engaging the toothed rack.

9. A toy tea kettle according to claim 7 wherein the body is hollow and has a cover having a pair of spaced-apart sleeved openings, wherein the handle comprises a U-shaped hollow member having a center handle portion and parallel hollow legs slidably movable in the sleeved openings, wherein the lid is pivotally mounted on the spout and has an oppositely extending finger intermittently engaging a toothed rack, and wherein the toothed rack is on one of the legs.

10. A toy tea kettle according to claim 9 wherein the toothed rack is slidably mounted on the handle, wherein cam follower means are mounted on the one leg, wherein a reciprocally movable plunger is mounted on the one leg for movement between a normal up position and a down position, wherein cam means are mounted on the plunger for actuating the cam follower means upon movement of the plunger to its down position, and wherein guide means are provided between the rack and the one leg for guiding the rack in a laterally downward direction for moving and holding the lid in a fully open position upon movement of the plunger to its down position.

11. A toy tea kettle according to claim 10 wherein the one leg has a slot within which the rack is slidably mounted, the plunger is reciprocally movable within the one leg, the cam follower means comprises a laterally extending pin on the rack, the cam means comprises an inclined surface on the plunger in engagement with the pin, and the guide means comprises a lug on the rack sliding in a groove in said one leg.

12. A toy tea kettle according to claim 11 wherein a spring is interposed between the handle and the plugner for biasing the plunger to its normal up position.

13. A toy tea kettle comprising:

a body having a spout;

a lid on the spout movable between a normal closed position and an open position;

a handle supported by the body;

a reciprocally movable plunger mounted on the handle for movement between a normal up position and a down position;

a rack having a tooth slidably mounted on the handle; and cam follower means on the rack, cam means on the plunger, and guide means provided between the rack and the handle for guiding the rack in a laterally downward direction causing the tooth to engage, move and hold the lid in its open position upon movement of the plunger to its down position.

14. A toy tea kettle according to claim 13 wherein the handle has a hollow depending leg having a slot within which the rack is slidably mounted, the plunger is reciprocally movable within the hollow leg, the cam follower means comprise a laterally extending pin on the rack, the cam means comprises an inclined surface on the plunger in engagement with the pin, and the guide means comprise a lug on the rack sliding in a groove in the leg.

15. A toy tea kettle according to claim 14 wherein a spring is interposed between the handle and the plunger for biasing the plunger to its normal up position.

* * * * *